United States Patent [19]

Fujiwara et al.

[11] Patent Number: 4,550,886

[45] Date of Patent: Nov. 5, 1985

[54] YARN END SUCKING AND HOLDING DEVICE IN WINDER

[75] Inventors: Michiaki Fujiwara, Kameoka; Toshiharu Ikeda, Kusatsu, both of Japan

[73] Assignee: Murata Kikai Kabushiki Kaisha, Japan

[21] Appl. No.: 606,764

[22] Filed: May 3, 1984

[30] Foreign Application Priority Data

May 4, 1983 [JP] Japan ..... 58-67104[U]

[51] Int. Cl.[4] ..... B65H 54/22

[52] U.S. Cl. ..... 242/35.6 E

[58] Field of Search ..... 242/35.6 E, 35.6 R, 242/18 R, 35.5 R; 226/97; 57/305, 261, 263

[56] References Cited

U.S. PATENT DOCUMENTS 3,361,372 1/1968 Pesch ..... 242/35.6 E X

*Primary Examiner*—Stanley N. Gilreath

*Attorney, Agent, or Firm*—Spensley, Horn, Jubas & Lubitz

[57] ABSTRACT

A yarn end sucking and holding device for a package mounted on a winder. The yarn end sucking and holding device has a suction mouth with a slit formed thereon in parallel with the direction of axis of a package facing to a layer of yarn on the package and a engagement member in the form of a blade is fixedly fitted to a side wall of the suction mouth.

9 Claims, 6 Drawing Figures

YARN END SUCKING AND HOLDING DEVICE IN WINDER

BACKGROUND OF THE INVENTION

1. Field of the Invention

The present invention relates to a yarn end sucking and holding device for a package mounted on a winder.

2. Prior Art

In connection with winding of yarns spun in a spinning machine or rewinding a yarn wound on a wooden bobbin or the like, a yarn joining apparatus is provided in view of the occurrence of breakage or the like trouble with the yarn during the winding operation. The yarn joining apparatus is provided with a yarn end sucking and holding device adapted to take up a yarn end on the package and a yarn end on the delivery section of the spinning machine and to bring them to a knotter. When yard is broken, a yarn end is introduced into a suction mouth on the yarn end sucking and holding device under the influence of air suction while the yarn end sucking and holding device is caused to turn and thereafter the yarn end is guided to the knotter via it. At this moment the package is caused to rotate in the opposite direction to that during winding operation so as to facilitate drawing of yarn wound on the package. If yarn unwound from the package is entangled round a slub or a part of yarn is located below other yarn as illustrated in FIG. 1, yarn cannot be unwound from the package merely with the aid of suction force generated by air suction through the suction mouth of the yarn end sucking and holding device and there is rather a tendency of causing yarn in the yarn end sucking and holding device to be drawn out of the suction mouth as the yarn end sucking and holding device is turned in the opposite direction.

SUMMARY OF THE INVENTION

An object of the present invention is to provide a yarn end sucking and holding device in which a yarn end introduced therein is retained without drawing out.

According to the present invention, a yarn end which has been introduced in the yarn end sucking and holding device through a suction mouth thereof is brought in engagement to a yarn engagement member fixedly secured to the one side in the longitudinal direction of the suction mouth as the package is rotated in the opposite direction so that it can not be drawn out of the suction mouth.

DETAILED DESCRIPTION OF THE INVENTION

Figure 1:
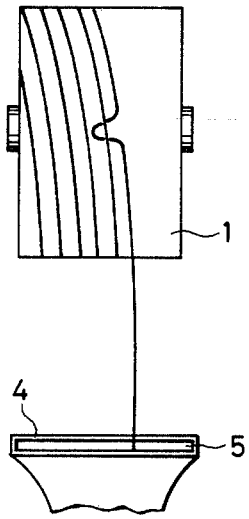
FIG. 1 is a schematic front view of a conventional yarn end sucking and holding device.

Now, the present invention will be described in detail hereunder with reference to the accompanying drawings which illustrate preferred embodiments thereof.

In the drawings reference numeral 1 designates a package which is supported by means of support members which are not shown in the drawings. The package 1 is adapted to rotate in the direction as shown by an arrow mark A in the drawing while drawing a yarn Y from spinning machine, wooden bobbin or the like means. Thus, a layer of yarn is formed over the outer surface of the package 1.

Further, reference numeral 2 designates a yarn end sucking and holding device which is turnably supported about a shaft 3. The yarn end sucking and holding device 2 is extended in the cylindrical configuration to be in communication with an air suction station which is not shown in the drawing, whereas it is provided with suction mouth 4. The suction mouth 4 has an elongated slit 5 extending in parallel with the X-direction along the axis of the package 1.

A yarn end engagement member 6 is secured to the one side edge of the elongated slit 5 extending in parallel with the direction X of axis of the package 1 so that it is projected downwardly into the slit 5. Specifically, the yarn end engagement member 6 is located on the suction mouth 4 at the opposite side relative to the normal direction of rotation of the package 1 (the direction of rotation as shown by an arrow mark A during forming of the layer of yarn).

Figure 3:
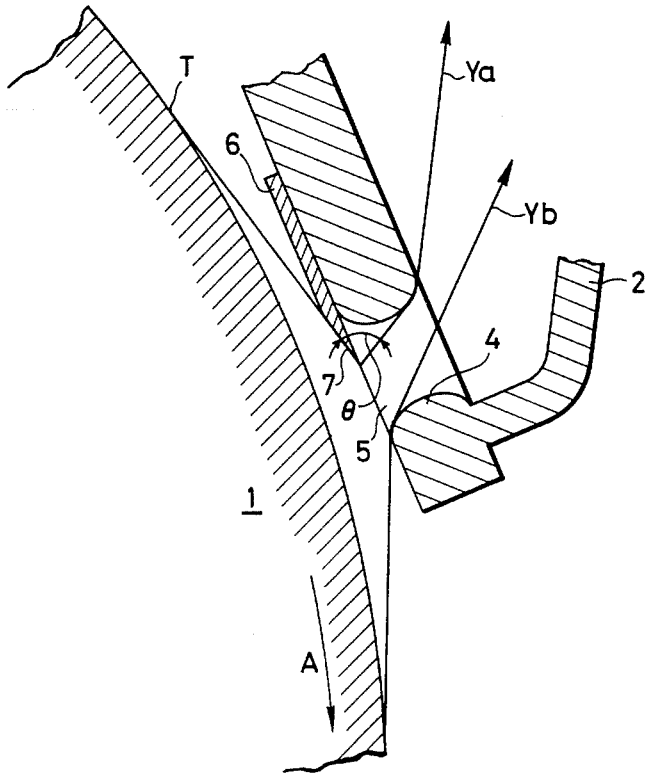
FIG. 3 is a fragmental sectional view illustrating an essential part of the device in an enlarged scale.
Figure 4:
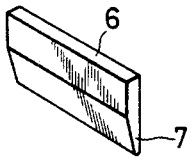
FIG. 4 is a perspective view of a yarn end engagement member.

The yarn end engagement member 6 is designed in the form of an elongated blade of which lower end part 7 is tapered downwardly. A degree of downward projection of the tapered end part 7 into the slit 5 is preferably determined in such a manner that a bent yarn Ya extending upwardly due to occurrence of trouble to be described later assumes an angle $\theta$ of 90 degrees or less relative to the tapered end part 7 of the yarn end engagement member 6, as illustrated in FIG. 3.

Figure 2:
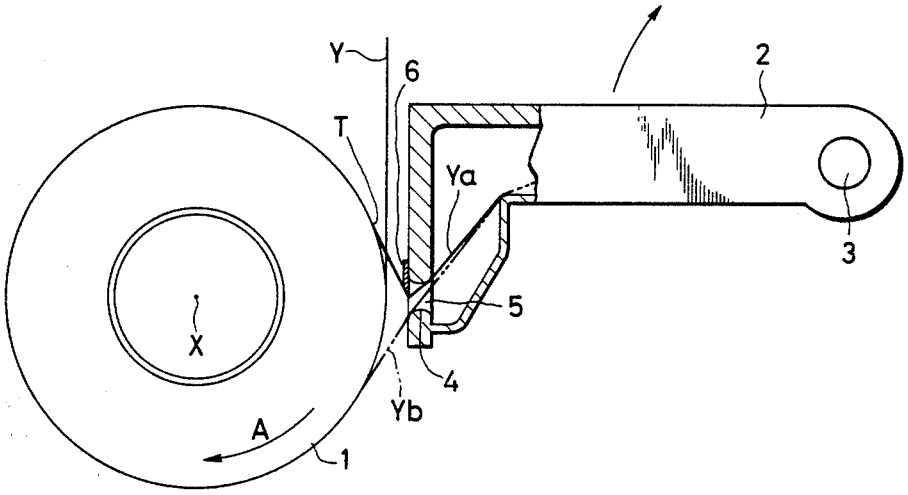
FIG. 2 is a partially sectioned side view of a yarn end sucking and holding device in accordance with an embodiment of the invention.

Now that it is assumed that yarn connection is conducted because of occurrence of breakage or the like trouble with yarn, to take up the yarn end from the package 1 for the purpose of yarn connection the package 1 is rotated in the opposite direction to that as shown by an arrow mark A in FIG. 1 and the yarn end sucking and holding device 2 is then caused to turn so as to allow the suction mouth 4 to approach the package 1 whereby the yarn end is unwound from the layer of yarn on the package 1 under the influence of suction through the mouth 4 to enter the yarn end sucking and holding device 2 from the slit 5. It should be noted that when a layer of yarn is formed on the package 1 in order, the yarn end is properly sucked into the yarn end sucking and holding device 2 along a track as shown by reference letter Yb in FIG. 2 but when a layer of yarn is formed incorrectly for some reason as typically illustrated in FIG. 1 where the yarn end part cannot be unwound, it is once sucked into the yarn end sucking and holding device 2 as the package 1 is rotated in the opposite direction but when the trouble part T moves away from the suction mouth 4, the yarn end which has been introduced into the yarn end sucking and holding device 2 via the suction mouth 4 is drawn out as the package 1 continues to be rotated in the opposite direction until it assumes the position as shown by reference letter Ya in FIG. 2. At this moment the yarn end Ya is bent by an angle of $\theta$ at the tapered end part 7 of the yarn end engagement member 6. Thus, the yarn end Ya resists against drawing force generated by reverse rotation of the package 1 while it abuts against the tapered end part 7, resulting in trouble such as entangling of yarn or the like in the layer of yarn on the package 1 being obviated. This causes the yarn end to be sucked again into the yarn end sucking and holding device 2 via the suction mouth 4 until the position as shown by reference numeral Yb in FIG. 2 is resumed. Thereafter, the yarn end is guided to a yarn joining device which is not shown in the drawings via the yarn end sucking and holding device 2.

Figure 5:
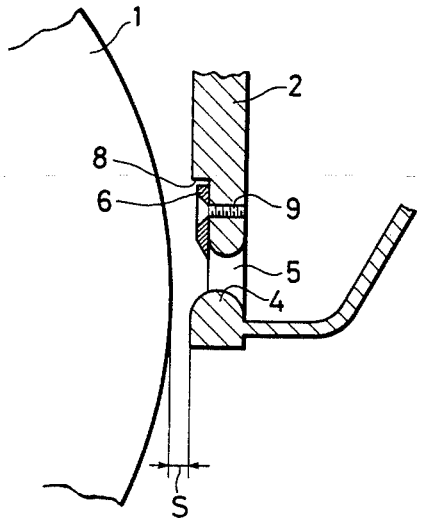
FIG. 5 is a fragmental sectional view of a yarn end sucking and holding device in accordance with a modified embodiment of the invention.

A modified embodiment as illustrated in FIG. 5 consists in that the suction mouth 4 is formed with a recessed portion 8 in which the yarn end engagement member 6 is fitted by set screws 9. An advantageous feature of the modified embodiment is that a distance S between the suction mouth 4 and the layer of yarn on the package 1 can be minimized.

Figure 6:
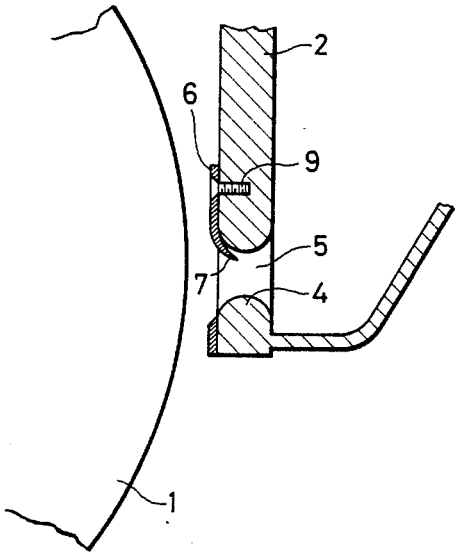
FIG. 6 is a fragmental sectional view of a yarn end sucking and holding device in accordance with another modified embodiment of the invention.

Another modified embodiment as illustrated in FIG. 6 consists in that the tapered end part 7 of the yarn end engagement member 6 is bent inwardly into the suction mouth 4. An advantageous feature of the modified embodiment is that yarn end is easy to enter the yarn end sucking and holding device 2 via the suction mouth 4 but it is difficult to leave there.

In any one of the above-described embodiments of the invention the tapered end part of the yarn end engagement member may extend linearly or it may have a serrated configuration along the lower edge thereof.

As described above, a yarn end sucking and holding device of the invention is constructed such that it has a suction mouth with a slit formed thereon in parallel with the direction of axis of a package facing to a layer of yarn on the package and a yarn engagement member in the form of a blade is fixedly fitted to the one side wall in longitudinal direction of the suction mouth in such a manner that its tapered end part is projected downwardly into the slit. Thus, when yarn connection is to be carried out in the event of occurrence of breakage of yarn, yarn end on the package can be transferred to a yarn connecting device without fail while it is brought in engagement to the yarn engagement member with any trouble on the package obviated, irrespective of how difficult it is drawn from the layer of yarn on the package because of the aforesaid trouble relative to yarn.

What is claimed is:

1. A yarn end sucking and holding device for a package rotatably mounted on a winder, the package being rotatable about an axis passing through the center of the package, characterized in that said device includes:

a generally L-shaped body having two legs, one leg being tangential to the package and the other leg being perpendicular to said one leg and extending away from said package, the free end portion of said one leg having a suction slit formed thereon parallel with the direction of the axis of the package and facing to a layer of yarn on the package; and a yarn engagement member in the form of a blade having a tapered end, the blade member being fixedly attached to the outside of said one leg so that its tapered end part is projected downwardly into the slit, the edge of the tapered end being sufficiently blunt so that when a yarn end is pressed against the end, the yarn end remains uncut.

2. A yarn end sucking and holding device as claimed in claim 1, wherein said suction mouth is formed with a recessed portion in which the yarn end engagement member is fitted by a set screw.

3. A yarn end sucking and holding device as claimed in claim 1, wherein said tapered end part of the yarn end engagement member is bent inwardly into the suction mouth.

4. A yarn end sucking and holding device as claimed in claim 1, wherein said tapered end part of the yarn end engagement member has a serrated configuration along the lower edge thereof.

5. A yarn end sucking and holding device as claimed in claim 2, wherein said tapered end part of the yarn end engagement member has a serrated configuration along the lower edge thereof.

6. A yarn end sucking and holding device as claimed in claim 3, wherein said tapered end part of the yarn end engagement member has a serrated configuration along the lower edge thereof.

7. A device for guiding a yarn end to a knotting device of an apparatus of the type having a yarn package wound with yarn, the yarn package having a free yarn end, the yarn package rotatably mounted on a winder and rotating about an axis passing through the package center in a first direction when the package is being wound with yarn and in a second direction opposite the first direction when the package is being unwound, the device including:

a suction member having walls defining a generally L-shaped internal channel, one leg of the channel being generally tangential to the package, the wall portion defining said one leg having a slit formed therein for introducing said free yarn end into the channel, the slit being parallel to said axis; and a stationary restraining member having a tapered end and connected to the wall portion so that the tapered end extends into the slit, the lower edge of the tapered end being sufficiently blunt so as to be unable to cut the yarn end when the yarn end presses against the lower edge as a result of sufficient suction being applied to the suction member to bring the free yarn end through the slit into the channel, wherein when the free end of the yarn is in the channel and the package is rotated in the second direction, the portion of the yarn extending between the package and the edge of the tapered end and the portion of yarn extending from the edge of the tapered end into the channel form an angle of less than or equal to about 90°.

8. A device for guiding a yarn end to a knotting device according to claim 7, wherein the suction member is rotatable about a pivot axis passing through said other leg, the pivot axis being parallel to the package rotation axis.

9. In a winding apparatus of the type having a yarn end sucking and holding device including (i) a suction body having an internal channel, and having at one end a suction mouth, communicating with the channel, for introducing a free yarn end into the channel by suction, and (ii) a yarn package partially wound with yarn and having a free yarn end, the yarn package rotatable about an axis passing through the center of the package, the suction mouth having a slit formed therein, the slit being parallel to the axis, the improvement wherein a stationary tapered blade is affixed to the suction body, the tapered end of the blade extending into the slit, wherein the tapered end has a sufficiently blunt edge so that when sufficient suction is applied to the suction body so as to bring the free yarn end into the channel and in pressing engagement with the edge, the free yarn end remains uncut; and wherein the suction body is configured so that the tapered blade edge and the internal channel interact such that when the free yarn end is sucked into the channel, and the package rotated in its unwinding direction, the portion of yarn between the package and the tapered blade edge and the portion of yarn extending from the tapered blade edge into the channel form an angle of about 90° or less.

* * * * *